US008091846B1

(12) United States Patent
Britner

(10) Patent No.: US 8,091,846 B1
(45) Date of Patent: Jan. 10, 2012

(54) WORK SUPPORTING APPARATUS

(76) Inventor: John D Britner, Williamsport, MD (US)

( * ) Notice: Subject to any disclaimer, the term of this patent is extended or adjusted under 35 U.S.C. 154(b) by 112 days.

(21) Appl. No.: 12/587,082

(22) Filed: Oct. 2, 2009

Related U.S. Application Data

(60) Provisional application No. 61/195,915, filed on Oct. 14, 2008.

(51) Int. Cl.
*A47B 96/06* (2006.01)

(52) U.S. Cl. ..... 248/219.3; 248/300; 52/289; 403/346

(58) Field of Classification Search ..... 248/229.16, 248/229.26, 230.7, 231.81, 73, 74.1, 74.2, 248/62, 316.1, 218.4, 219.3, 214, 300; 403/346, 403/400; 52/289, 702, 712, 715, 655.1
See application file for complete search history.

(56) References Cited

U.S. PATENT DOCUMENTS

| | | | | | |
|---|---|---|---|---|---|
| 704,884 | A * | 7/1902 | Lally | 403/169 |
| 1,418,699 | A * | 6/1922 | Collins | 403/385 |
| 1,808,628 | A * | 6/1931 | Bond | 248/263 |
| 1,905,616 | A * | 4/1933 | Zanella | 52/715 |
| 2,025,794 | A * | 12/1935 | Venzie | 52/355 |
| 2,115,625 | A * | 4/1938 | Fleshman | 52/370 |
| 2,157,688 | A * | 5/1939 | Stanley | 52/381 |
| 2,213,355 | A * | 9/1940 | Woodworth | 52/302.3 |
| 2,227,570 | A * | 1/1941 | Burson | 52/489.1 |
| 2,351,525 | A * | 6/1944 | Leary | 52/285.3 |
| 2,704,868 | A * | 3/1955 | Danielson | 52/210 |
| 2,942,314 | A * | 6/1960 | Debner et al. | 403/391 |
| 3,003,735 | A * | 10/1961 | Havener | 248/228.7 |
| 3,210,898 | A * | 10/1965 | Kurtz | 52/281 |
| 3,256,030 | A * | 6/1966 | Banse | 403/400 |
| 3,785,110 | A * | 1/1974 | Galloway et al. | 52/715 |
| 4,191,352 | A * | 3/1980 | Schuplin | 248/317 |
| 4,221,355 | A * | 9/1980 | Hoop | 248/340 |
| 4,323,215 | A * | 4/1982 | Berger | 248/544 |
| 5,024,405 | A * | 6/1991 | McGuire | 248/73 |
| 5,170,977 | A * | 12/1992 | McMillan | 248/300 |
| 5,351,920 | A * | 10/1994 | Decky et al. | 248/73 |
| 5,358,205 | A * | 10/1994 | Starkey et al. | 248/220.21 |
| 5,836,055 | A * | 11/1998 | Cooper | 24/339 |
| 6,422,523 | B1 * | 7/2002 | Weshler | 248/222.52 |
| 6,560,943 | B1 * | 5/2003 | Leek et al. | 52/715 |
| 6,631,876 | B1 * | 10/2003 | Phillips | 248/74.2 |
| 6,640,516 | B1 * | 11/2003 | Thompson | 52/712 |
| 7,806,583 | B2 * | 10/2010 | Oswald | 366/123 |

* cited by examiner

*Primary Examiner* — Kimberly Wood
(74) *Attorney, Agent, or Firm* — Donald A. Kettlestrings

(57) ABSTRACT

A device for use at construction sites, the device having a plurality of brackets for quickly and easily mounting the device on building studs and for supporting a length of material, such as a two by four, and wherein two or more of the devices can be mounted on neighboring building studs to create a work or work surface supporting apparatus.

6 Claims, 7 Drawing Sheets

WORK SUPPORTING APPARATUS

CROSS-REFERENCE TO RELATED APPLICATIONS

This application claims the benefit of U.S. provisional application No. 61/195,915, filed Oct. 14, 2008.

BACKGROUND OF THE INVENTION

This invention relates to a device and apparatus for supporting work or work surfaces and more particularly to such a device and apparatus for use at building construction sites. Building construction sights now typically use saw horses or other temporarily assembled supports for supporting work or work surfaces at the construction site. This is often inconvenient and time consuming because saw horses may not be readily available or may be in use for other purposes. If construction workers are required to assemble temporary supports, their time is not being efficiently used in the construction process.

SUMMARY OF THE INVENTION

It is, therefore, an object of the present invention to provide a device and apparatus for supporting work or a work surface at a building construction site.

Another object is to provide such a device and apparatus which can be quickly and easily positioned and held on vertical building studs.

A further object of the invention is the provision of such a device and apparatus which can be quickly positioned and easily assembled and disassembled at the construction site.

Still another object is to provide such a device which can be readily stored and transported.

Yet another object of the present invention is the provision of such an apparatus which uses the device of this invention and which apparatus can be assembled and disassembled at the construction site without the use of tools.

Another object is to provide such an apparatus which uses the device of this invention together with readily available lengths of lumber at the construction site.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

BRIEF SUMMARY OF THE INVENTION

To achieve these and other objects, the present invention provides a device for receiving and supporting a first length of material adjacent to a first member, the device comprising: a first flat element defining first and second opposed flat surfaces and first, second, third and fourth perimeter edges; a first right-angle bracket connected to the second surface; a second right-angle bracket connected to the second surface; the first and second brackets positioned in cooperating relationship with each other and with the flat element for removably supporting the device on the first member; a third right-angle bracket connected to the first surface; a fourth substantially right-angle bracket connected to the first surface; and the third and fourth brackets positioned in cooperating relationship with each other and with the flat element for removably receiving and supporting the first length of material adjacent to the first member.

BRIEF DESCRIPTION OF THE SEVERAL VIEWS OF THE DRAWINGS

The accompanying drawings, which are incorporated in and constitute a part of this specification, illustrate a preferred embodiment of the invention and, together with the description, serve to explain the principles of the invention.

DETAILED DESCRIPTION OF THE INVENTION

Figure 1:
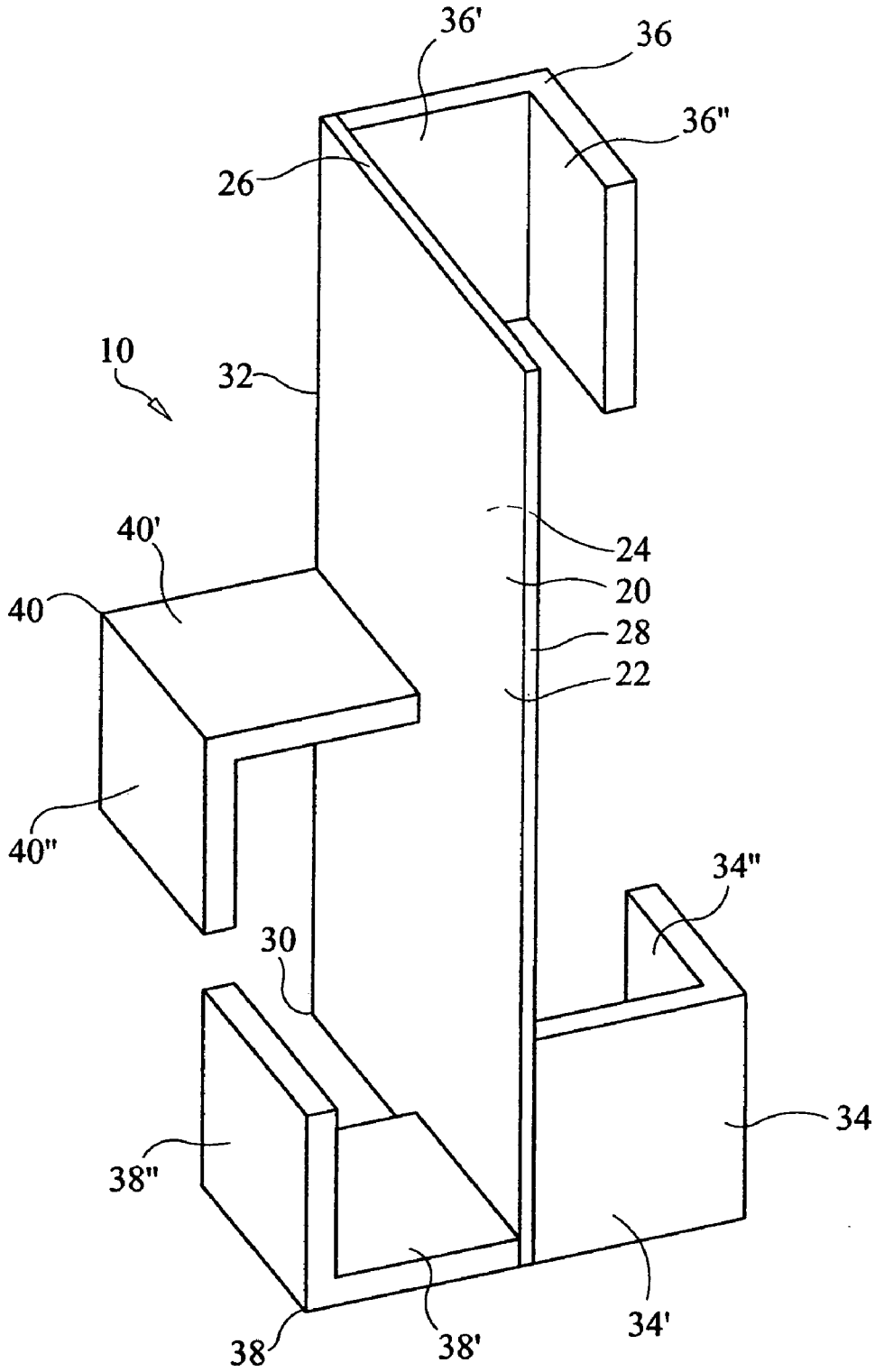
FIG. 1 is a perspective view of the receiving and supporting device of this invention.
Figure 2:
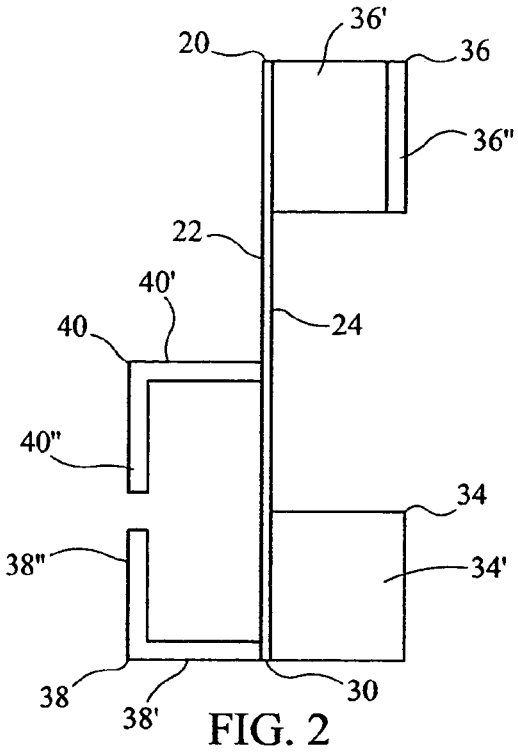
FIG. 2 is a front elevation view of the device shown in FIG. 1.
Figure 3:
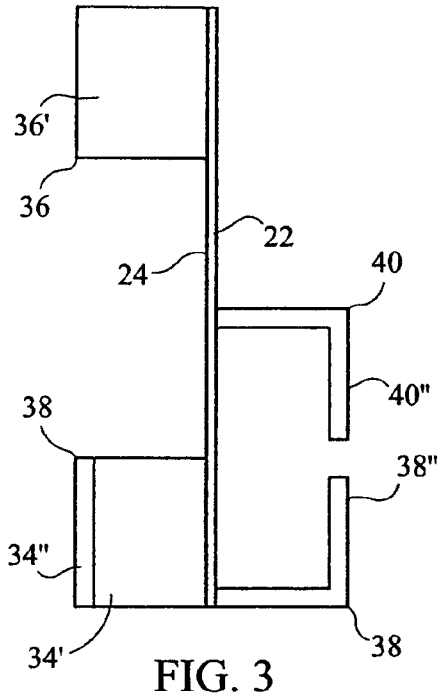
FIG. 3 is a rear elevation view of the device.
Figure 4:
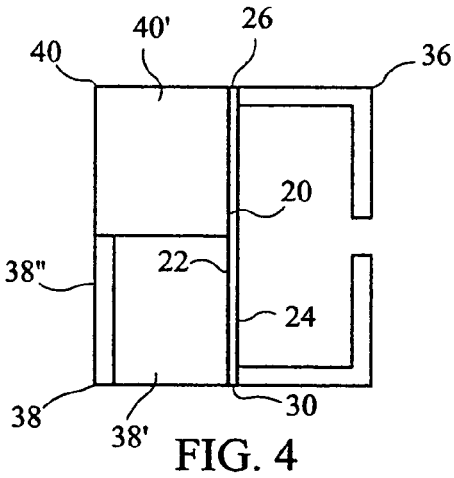
FIG. 4 is a top plan view of the device.
Figure 5:
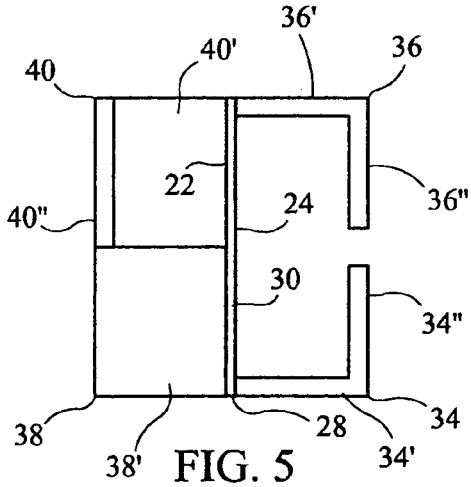
FIG. 5 is a bottom plan view of the device.
Figure 6:
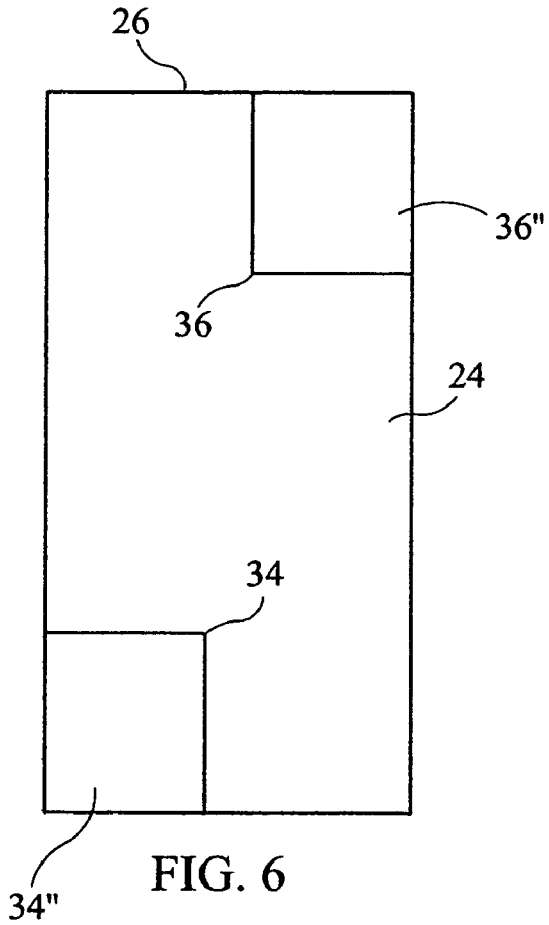
FIG. 6 is a right side elevation view of the device.
Figure 7:
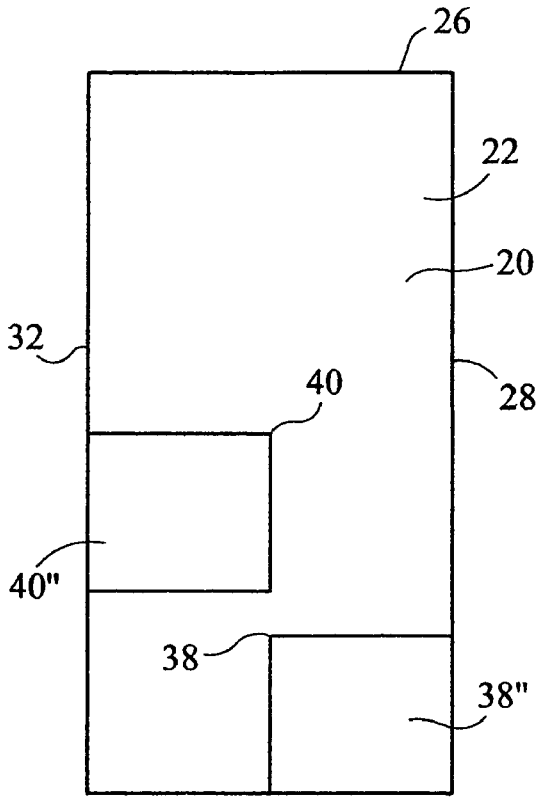
FIG. 7 is a left side elevation view of the device.
Figure 8:
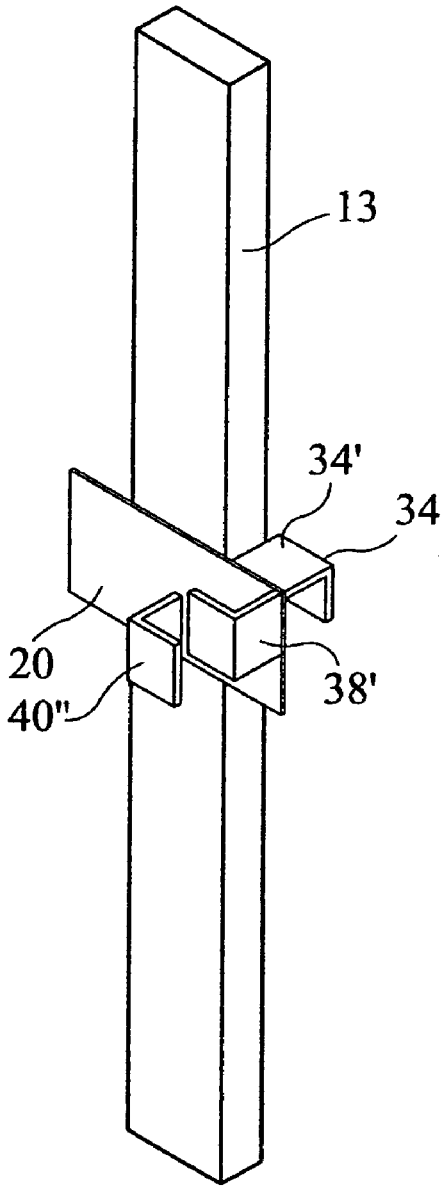
FIG. 8 is a perspective view showing the device as it is initially positioned adjacent to a building stud.
Figure 9:
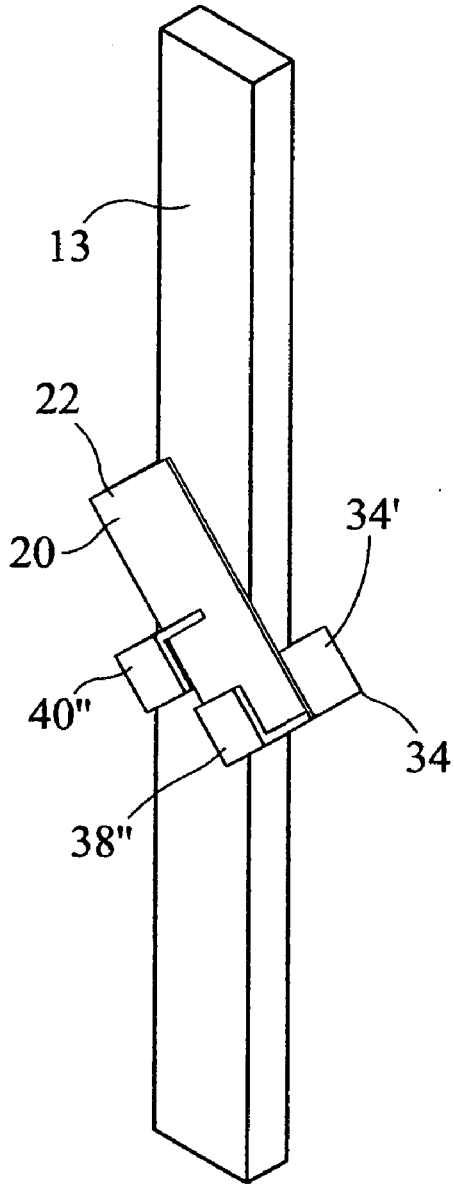
FIG. 9 is a perspective view illustrating how the device is rotated from its position shown in FIG. 8 in the process of mounting the device onto a stud.
Figure 10:
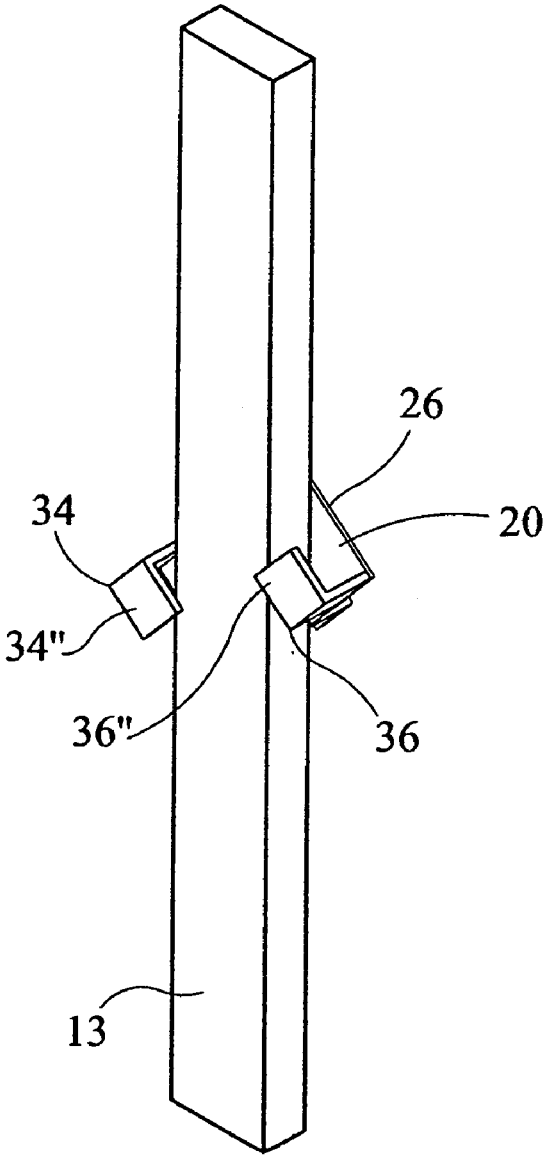
FIG. 10 is a different perspective view of the device as it is illustrated in FIG. 9.
Figure 11:
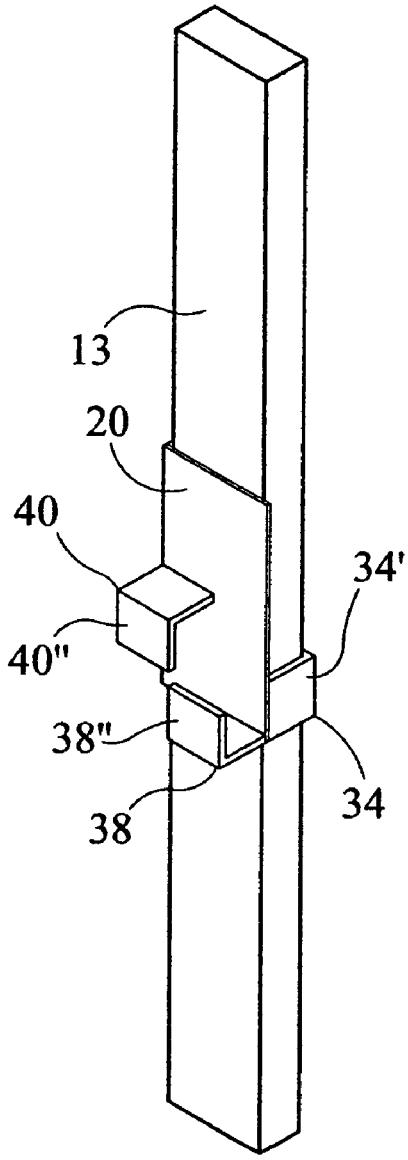
FIG. 11 is a perspective view of the device mounted on a building stud and positioned ready for use.

With reference now to the drawings, wherein like reference characters designate like or corresponding parts throughout the several views, there is shown a device 10 in accordance with the invention for receiving and supporting a first length of material 11 adjacent to a first member 13.

Device 10 includes a first substantially flat element 20 defining first 22 and second 24 opposed substantially flat surfaces and first 26, second 28, third 30 and fourth 32 perimeter edges.

In accordance with the invention, device 10 further includes a first 34 substantially right-angle bracket connected to second surface 24 and a second 36 substantially right-angle bracket connected to second surface 24.

The first 34 and second 36 brackets are positioned in cooperating relationship with each other and with flat element 20 for removably supporting device 10 on first member 13.

Device 10 further includes a third 38 substantially right-angle bracket connected to first surface 22 and a fourth 40 substantially right-angle bracket connected to first surface 22.

Third 38 and fourth 40 brackets are positioned in cooperating relationship with each other and with flat element 20 for removably receiving and supporting first length of material 11 adjacent to first member 13.

First bracket 34 defines a first part 34' substantially perpendicularly connected to second surface 24 and a second part 34" substantially perpendicularly connected to first part 34'.

Second bracket 36 defines a third part 36' substantially perpendicularly connected to second surface 24 and a fourth part 36" substantially perpendicularly connected to third part 36'.

Second 34" and fourth 36" parts extend inwardly of device 10 with respect to second 28 and fourth 32 edges, respectively.

Third bracket 38 defines a fifth part 38' substantially perpendicularly connected to first surface 22 and a sixth part 38" substantially perpendicularly connected to fifth part 38'.

Fourth bracket 40 defines a seventh part 40' substantially perpendicularly connected to first surface 22 and an eighth part 40" substantially perpendicularly connected to seventh part 40'.

Sixth part 38" extends inwardly of device 10 with respect to third edge 30 and eighth part 40" extends in a direction away from first edge 26 and toward third edge 30.

First member 13 is a substantially vertically oriented structural wall stud and first 34 and second 36 brackets are sized and positioned on flat element 20 for removably receiving stud 13 between second part 34" and flat element 20 and between fourth part 36" and flat element 20, respectively, when device 10 is positioned on stud 13.

First part 34' and third part 36' are positioned on flat element 20 to simultaneously engage stud 13 when device 10 is positioned on the stud.

Third 38 and fourth 40 brackets are positioned with respect to each other on flat element 20 to cooperatively receive and support first length of material 11 when the length of material is positioned between third 38 and fourth 40 brackets.

First length of material 11 is a length of lumber of predetermined dimensions, such as a two by four.

First bracket 34 is connected in adjacent relationship with second 28 and third 30 edges and second bracket 36 is connected in adjacent relationship with first 26 and fourth 32 edges.

Third bracket 38 is connected in adjacent relationship with second 28 and third 30 edges.

Fourth bracket 40 is connected in adjacent relationship with fourth edge 32 and seventh part 40' is connected to flat element 20 substantially midway between first 26 and third 30 edges.

Each of first 34', second 34", third 36', fourth 36", fifth 38', sixth 38", seventh 40' and eighth 40" parts are flat.

Device 10 is preferably comprised of metal and each of the brackets is preferably welded to flat element 20.

Fifth 38' and seventh 40' parts extend equal distances from first surface 22 and first 34' and third 36' parts extend equal distances from second surface 24.

Figure 13:
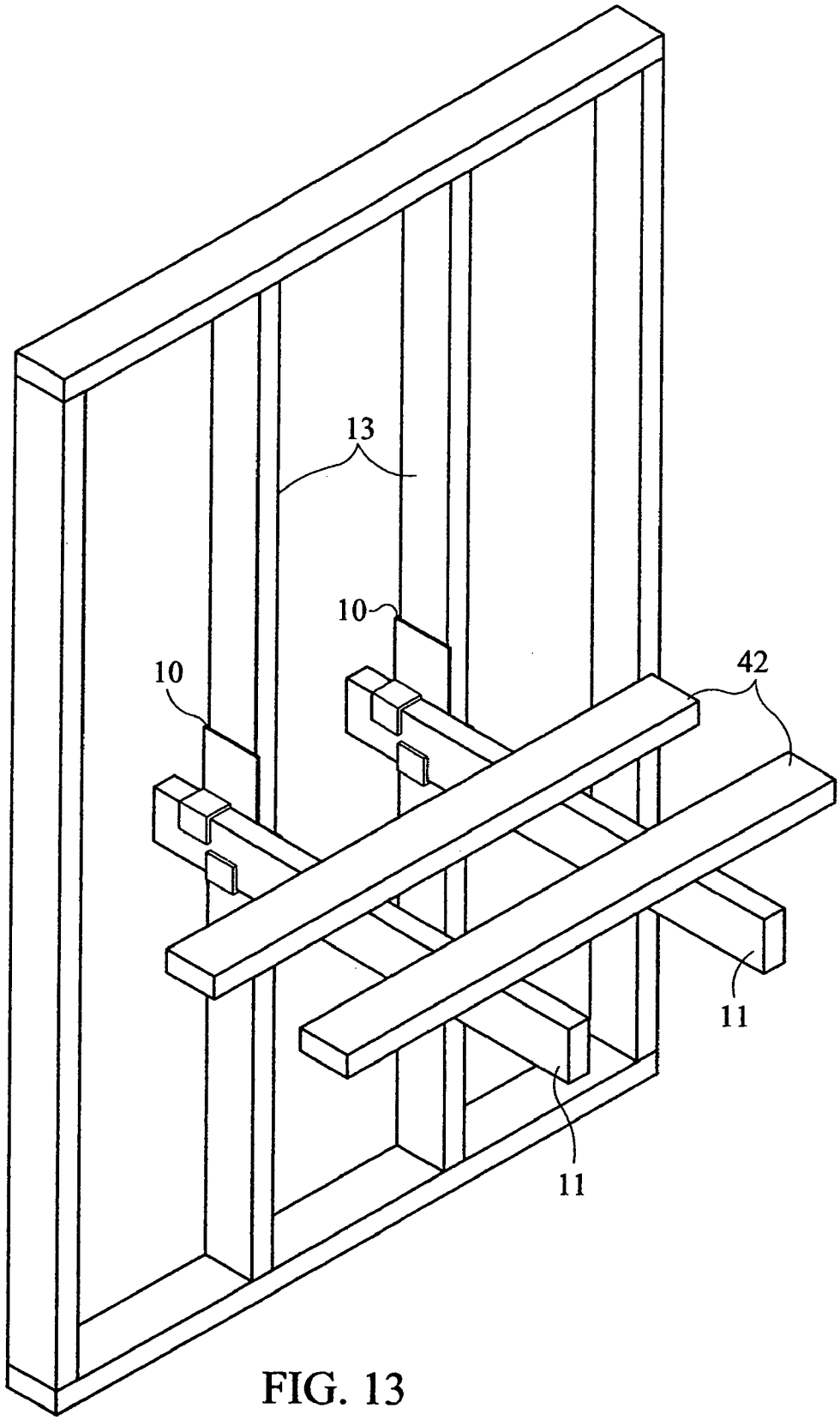
FIG. 13 is a perspective view showing two of the devices mounted on neighboring studs with each device supporting a length of lumber to provide apparatus for supporting work or a work surface.

Work supporting apparatus as shown in FIG. 13 includes two of devices 10 positioned on neighboring ones of first members or studs 13. As shown in FIG. 13, each of devices 10 supports one length of material 11 for receiving and supporting work or work surface 42 on lengths of material 11.

Figure 12:
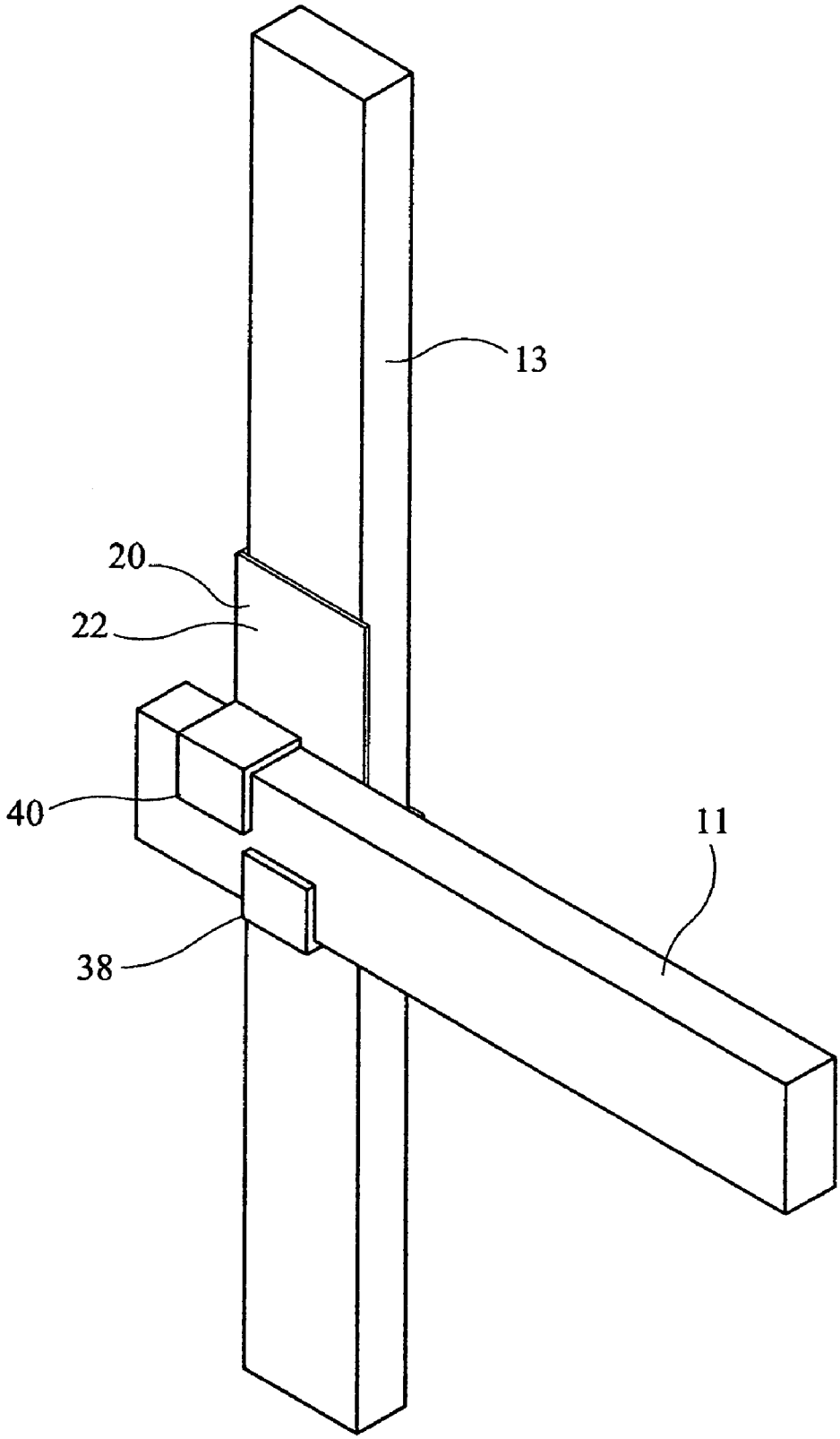
FIG. 12 is a perspective view of the device mounted on a building stud and having a length of lumber supported by the device.

In operation and use, devices 10 are positioned onto studs 13 by positioning and moving devices 10 in a sequence shown in FIGS. 8-11. No tools are required to accomplish this. Lengths of material or lumber 11 are then positioned in supporting relationship with respect to each device 10 as shown in FIGS. 12 and 13.

Two or more of devices 10 can be positioned onto neighboring ones of studs 13, as shown in FIG. 13, and work or work surfaces 42 are positioned onto lengths of material 11. Work 42 can then be cut or otherwise manipulated while being supported by lengths of material 11.

Elements 42 illustrated in FIG. 13 may also be a flat sheet or sheets of plywood or other flat material if it is desired to create a temporary desk or table at the construction site.

The invention in its broader aspects is not limited to the specific details shown and described, and departures may be made from such details without departing from the principles of the invention and without sacrificing its chief advantages.

What is claimed is:

1. A device (10) for receiving and supporting a first length of material (11) adjacent to a first (13) member, said device (10) comprising:

a first substantially flat element (20) defining first (22) and second (24) opposed substantially flat surfaces and first (26), second (28), third (30) and fourth (32) perimeter edges;

a first (34) substantially right-angle bracket connected to said second (24) surface;

a second (36) substantially right-angle bracket connected to said second (24) surface;

said first (34) and second (36) brackets positioned in cooperating relationship with each other and with said flat element (20) for removably supporting said device (10) on said first member (13);

a third (38) substantially right-angle bracket connected to said first (22) surface;

a fourth (40) substantially right-angle bracket connected to said first (22) surface;

said third (38) and fourth (40) brackets positioned in cooperating relationship with each other and with said flat element (20) for removably receiving and supporting said first length of material (11) adjacent to said first member (13);

wherein said first (34) bracket defines a first (34') part substantially perpendicularly connected to said second (24) surface and a second (34") part substantially perpendicularly connected to said first (34') part;

wherein said second (36) bracket defines a third (36') part substantially perpendicularly connected to said second (24) surface and a fourth (36") part substantially perpendicularly connected to said third (36') part;

wherein said second (34") and fourth (36") parts extend inwardly of said device (10) with respect to said second (28) and said fourth (32) edges, respectively;

wherein said third (38) bracket defines a fifth (38') part substantially perpendicularly connected to said first (22) surface and a sixth (38") part substantially perpendicularly connected to said fifth (38') part;

wherein said fourth (40) bracket defines a seventh (40') part substantially perpendicularly connected to said first (22) surface and an eighth (40") part substantially perpendicularly connected to said seventh (40') part;

wherein said sixth (38") part extends inwardly of said device (10) with respect to said third (30) edge and wherein said eighth (40") part extends in a direction away from said first (26) edge and toward said third (30) edge;

wherein said first (13) member is a substantially vertically oriented structural wall stud (13) and wherein said first (34) and said second (36) brackets are sized and positioned on said flat element (20) for removably receiving said stud (13) between said second (34") part and said flat element (20) and between said fourth (36") part and said flat element (20), respectively, when said device (10) is positioned on said stud (13);

wherein said first (34') part and said third (36') part are positioned on said flat element (20) to simultaneously engage said stud (13) when said device (10) is positioned on said stud (13);

wherein said third (38) and said fourth (40) brackets are positioned with respect to each other on said flat element (20) to cooperatively receive and support said first length of material (11) when said first length of material (11) is positioned between said third (38) and said fourth (40) brackets;

wherein said first length of material (11) is a length of lumber of predetermined dimensions;

wherein said first (34) bracket is connected in adjacent relationship with said second (28) and said third (30) edges and wherein said second (36) bracket is connected in adjacent relationship with said first (26) and said fourth (32) edges;

wherein said third (38) bracket is connected in adjacent relationship with said second (28) and said third (30) edges; and wherein said fourth (40) bracket is connected in adjacent relationship with said fourth (32) edge and wherein said seventh (40') part is connected to said flat element (20) substantially midway between said first (26) and said third (30) edges.

2. A device (10) as in claim 1 wherein each of said first (34'), second (34"), third (36'), fourth (36"), fifth (38'), sixth (38"), seventh (40') and eighth (40") parts are flat.

3. A device (10) as in claim 2 wherein said fifth (38') and said seventh (40') parts extend equal distances from said first (22) surface.

4. A device (10) as in claim 3 wherein said first (34') and said third (36') parts extend equal distances from said second (24) surface.

5. A device (10) as in claim 4 which is comprised of metal and wherein said brackets are welded to said flat element (20).

6. Work supporting apparatus, comprising:

first and second of said receiving and supporting devices (10) as recited in claim 1 positioned on neighboring ones of said first members (13);

each of said devices (10) supporting one of said first lengths of material (11) as received in claim 1 for receiving and supporting work (42) or a work surface 42 on said first lengths of material (11).

* * * * *